United States Patent [19]

Hurni

[11] Patent Number: 4,458,600

[45] Date of Patent: Jul. 10, 1984

[54] RAILWAY TRACK TAMPING MACHINE

[75] Inventor: Hans Hurni, Ecublens, Switzerland

[73] Assignee: Sig Societe Industrielle Suisse, Chutes du Rhin, Switzerland

[21] Appl. No.: 321,200

[22] Filed: Nov. 13, 1981

[30] Foreign Application Priority Data

Nov. 24, 1980 [CH] Switzerland ..... 8652/80

[51] Int. Cl.[3] ..... E01B 27/16

[52] U.S. Cl. ..... 104/12

[58] Field of Search ..... 104/12, 10; 318/591, 318/446

[56] References Cited

U.S. PATENT DOCUMENTS

| | | | |
|---|---|---|---|
| 2,734,155 | 2/1956 | Schuck | 318/591 |
| 3,036,253 | 5/1962 | Bramley | 318/591 |
| 3,534,687 | 10/1970 | Plasser et al. | 104/12 |

*Primary Examiner*—Randolph Reese
*Assistant Examiner*—Gregory A. Beehner
*Attorney, Agent, or Firm*—Anthony J. Casella; Gerald E. Hespos

[57] ABSTRACT

The tamping machine comprises, for each row of rails (6) a tamping unit (4) which is movable in the transverse direction of the track in order to tamp the track switches.

The controlled transverse mobility of each tamping unit, to the right and the left of the line of rails, is obtained by the combination of a lever manual control member (26) and an automatic control circuit (38) which is controlled by two amplitude limiters (34, 36).

A switch (32) makes it possible to change from manual to automatic and vice versa.

By presetting the amplitude limiter at a value corresponding to a transverse position of the tamping unit which is repeated several times along the track switch, the positioning of the tamping unit is obtained by simple actuation of the switch upon arrival at these recurrent positions.

1 Claim, 5 Drawing Figures

RAILWAY TRACK TAMPING MACHINE

The object of the present invention is a railway track tamping machine of the known type the rolling chassis of which comprises, arranged above each of the two lines of rail, at least one tamping unit movable at least in the transverse direction of the track to permit the tamping of track switches such as turnouts and cross-overs upon arrival at said switches at least one motor for transversely displacing said tamping unit, an energy circuit for feeding said motor and at least one manual control member connected to the energy circuit to start and stop said displacement.

The invention relates more particularly, but not exclusively, to tamping machines of this type which are used for tamping in railway stations, namely places where there are a large number of switches and for which the economic factor is preponderant.

On these tamping machines as on all those suitable for the tamping of track switches, the problem of the transverse mobility of the tamping units no longer arises in practice and the present embodiments make it possible to move these units sufficiently away from the rails of the track traversed to assure a complete and balanced tamping of long ties such as those found, for instance, on switches. However, even as a result of this it is not possible for a tamper operator engaged in correctly positioning the tamping tools on the outside of a part of a switch remote from a line of rails at the same time to position the tools of the unit or units of the other line of rails on the other side of the machine, they being too far away from his field of view. This is why, in order to assure an output sufficient best to utilize the time intervals between the passage of the trains, two stations of tamper operators are generally installed on these tamping machines, each of the two tampers concerning himself solely with one of the two lines of rails.

The result of this is that on the open track, that is to say between the regions occupied by the switches, the two tamper operators are under-employed. A single tamper operator would, in fact, be sufficient in this case to effect all of the tamping under the two lines of rails, the transverse positioning of the tamping units having to be effected only once for both lines at the outlet end of the switch and remaining constant up to the next switch. It will be noted here that even, for instance, on a single turnout, the tamper operator in charge of the transverse positioning of the tamping units around the line of rails opposite the one located on the side of the competitive track is also under-employed as compared with the other tamper operator since far fewer changes in transverse position of the tamping units are required around said line than are necessary around the other line.

As soon as one attempts to improve the output of the said tamping machines, one thus is confronted by a dilemma since either one increases the output of the machine by using two tamper operators, which solution, as we have just seen, results in their being periodically under-employed, or else one uses only a single tamper operator, but to the detriment of the output of the machine in the switches.

Moreover, for this same purpose of profitability, the desire to make the transverse positioning of the tamping units automatic in accordance with what has already been done in the longitudinal direction of the track in order to regulate the step-by-step advance of the tamping machine by detection of the obstacles created by the ties, is hindered by the size and complexity of the means for detecting the lateral obstacles created by the switches which would have to be installed in order to assure such automatic operation.

Without having recourse to these expensive means, which are of sensitive operation, and still for the same purpose of increasing profitability, the invention is directed at simplifying to a large extent the work of the tamper operator relating to the transverse positioning of the tamping tools along the track switches so as to increase his output without overloading him with work or overtiring him.

For this purpose, the tamping machine in accordance with the invention is characterized by the fact that it comprises a device for adjusting the amplitude of the transverse displacement of each of its tamping units, comprising at least one amplitude-limiter adjustable to values corresponding to selected transverse end-of-stroke positions of the tamping unit and an automatic control circuit controlled by said amplitude-limiter and connected to the energy circuit feeding the motor which is responsible for the transverse displacement of the said unit via a switch member inserted in the line connecting said energy circuit to the manual control member for the said transverse displacement.

In this way, by presetting the amplitude limiter to at least one value corresponding to at least one known recurrent transverse position of the tamping unit which is found at several places along the switch, such as, for instance, its open-track position, it is possible to assure the automatic transverse positioning of this tamping unit, upon arrival at these places, by simple actuating of the switch member.

An appreciable saving in time is thus obtained as compared with the total time at present necessary for the tamping of a track switch, since the recurring transverse tamping positions are numerous along these switches and this saving in time is such as to make it possible to contemplate the manufacture of inexpensive tamping machines simply equipped with a single tamping unit per line of rail and operated by a single tamper operator, without thereby sacrificing the output.

Other possibilities and advantages inherent in the invention will become evident from the following description.

The accompanying drawing shows, by way of illustration, one embodiment of the tamping machine of the invention.

Figure 1:
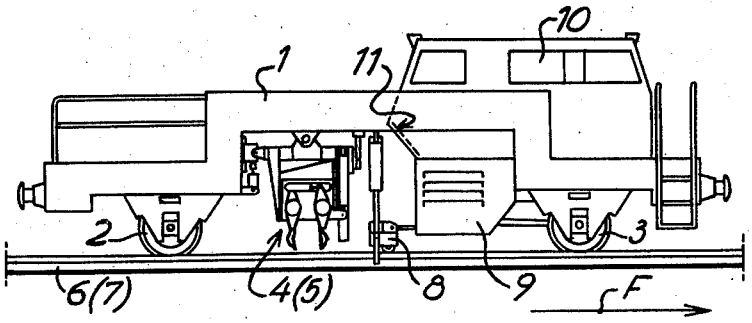
FIG. 1 is an overall longitudinal view thereof.

The tamping machine shown in FIG. 1 is self-propelled. It has a rolling chassis 1 with two axles 2 and 3 and is equipped with two tamping units 4 (5), arranged one above each of the two lines of rails 6 (7), a track displacement device 8, a power station 9 and a driving and control cab 10 which provides a view of the track to the front and the rear of the tamping machine depending upon the direction of advance in work, indicated by the arrow F, as well as of all the working tools of the tamping units and of the displacement device through an inner central window 11.

Figure 2:
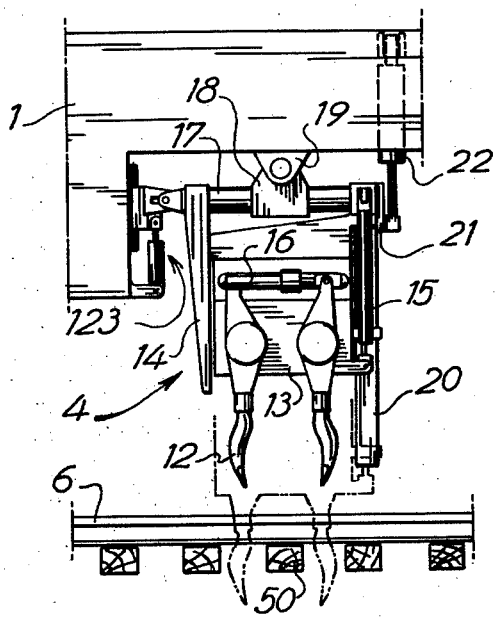
FIGS. 2 and 3 are a longitudinal and a transverse detailed view respectively of its tamping units.
Figure 3:
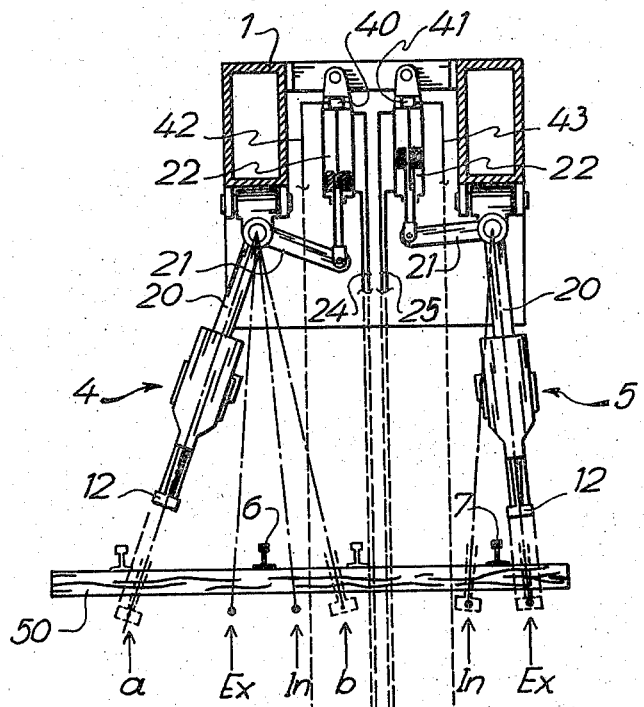

Each tamping unit, which is shown on a larger scale in FIGS. 2 and 3, has two conventional vibrating pivoting tools 12 in the form of picks, mounted, in opposition, articulated on a tool holder 13 which is vertically movable by vertical sliding in the two uprights of a gantry 14 which in its turn is mounted for movement in a vertical plane transverse to the track by articulation of its upper portion on the frame 1.

The plunging of the two tools 12 into the ballast as well as the raising of them is obtained by the action of a hydraulic jack 15 arranged between the tool holder 13 and the gantry 14, and their opening and closing is effected by a hydraulic jack 16 interposed between each of them and the tool holder 13.

The transverse mobility of each tamping unit 4 and 5 is obtained by pivoting. For this purpose, the cross member 17 of the gantry 14 is articulated in a bearing 18 connected to the frame 1 via a yoke 19, in which this bearing is in its turn articulated in a vertical plane parallel to the track. One of the uprights 20 of the gantry 14 has a right-angle arm 21 which extends towards the interior of the frame. The controlled transverse pivoting of each tamping unit formed in this manner is obtained by means of a double-acting hydraulic jack 22 interposed between the end of said arm 21 and the frame 1.

Furthermore, each tamping unit can pivot in the longitudinal direction of the track and round the axis of the yoke 19 via a mechanism 123 formed by a carriage which is moved vertically by a jack and has a horizontal slideway in which there is engaged an angular locking finger of the cross member 17 of the gantry 14 fastened to the end of said cross member. This mechanism 123 is intended to be used for the tamping of oblique ties in order to be able to shift the two tamping units 4 and 5 in the longitudinal direction of the track, but this detail is not indispensable.

Figure 4:
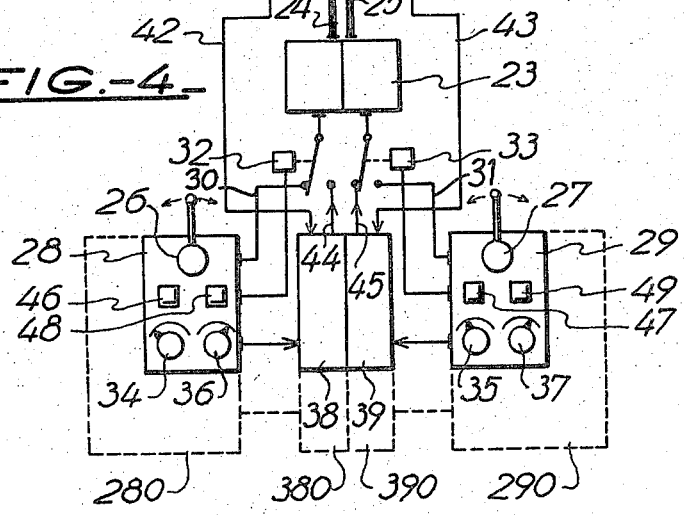
FIG. 4 is a diagram showing the control of these tamping units.

The motors and jacks for driving the tools of the tamping machine and in particular the two jacks 22 responsible for the transverse pivoting of the two tamping units 4 and 5 are connected to a hydraulic circuit for the feeding of fluid placed under pressure by the power station 9, which is indicated as 23 in the functional diagram shown in FIG. 4. This hydraulic circuit customarily comprises solenoid valves for the distribution of the fluid under pressure into the various chambers of the jacks in question.

Thus the two chambers of the two jacks 22 are connected by conduits 24 and 25 respectively to two solenoid valves of this hydraulic feed circuit 23.

These two solenoid valves (not shown) are controlled by two manual control members 26 and 27 with levers installed on two elements 28 and 29 of a control console which the tamper operator has within the cab 10 of the tamping machine. These two solenoid valves are connected to their control member by electric wires 30 and 31 respectively in which there is inserted a switch member 32 or 33 respectively. The two manual control members 26 and 27 have three positions, namely right, left and neutral at the center.

In this way, when the wires 30 and 31 are closed, then depending on the direction in which the levers of the manual control members 26 and 27 are moved the tamper operator distributes the pressurized fluid into one or the other chamber of the jacks 22 and can thus displace each of the two tamping units 4 and 5 to the left or to the right and then stop this displacement at the selected position by bringing the lever to the center. Depending on the nature of the solenoid valves used, namely all-on or all-off or else proportional, the speed of displacement of the tamping unit will be constant or else proportional to the angle of inclination imparted to the levers of the manual control members. This choice will be dictated by the manner of operation selected.

Combined with this manual control circuit, the tamping machine has a device for adjusting the amplitude of the transverse displacement of each of the two tamping units 4 and 5.

This adjusting device is made in the manner of a customary automatic adjustment circuit. It comprises for each of the two tamping units:

- two hand operated amplitude limiting means which are formed in this case by two adjustment potentiometers 34 and 36, respectively 35 and 37, installed on the elements 28, respectively 29, of the control console for setting the amplitude of the transverse displacement of each of said two tamping units at least at a selected value;
- an automatic control circuit 38, respectively 39, connected to and controlled by the amplitude limiting means and further adapted to be connected by a connection 44, respectively 45, via the switch member 32, respectively 33, to the hydraulic feed circuit 23 for displacing the tamping unit at the amplitude value selected and set by the amplitude limiting means;
- a position detector for the tamping unit which is formed in this case by a displacement detector 40, respectively 41, integrated in the jack 22 responsible for the transverse displacement of the tamping unit and connected by a wire 42, respectively 43, to the corresponding automatic control circuit, in order to supply the latter with an information on the actual transverse position of the tamping unit.

In this arrangement, each of the two groups of potentiometers 34, 36 and 35, 37 determines the end of stroke positions which are desired for each of the tamping units, that is to say the potentiometers 34 and 35 for the positions towards the left on FIG. 3, and the potentiometers 36 and 37 for the positions towards the right of these two tamping units. Still in this arrangement, the automatic control circuits 38, respectively 39, comprise the customary means for processing the signals coming from the said potentiometers 34, 36 and 35, 37 and detectors 40 and 41 to supply control signals for the displacement of the tamping units. The customary means comprise comparison means connected on one hand to the potentiometers 34, 36 and 35, 37 and on the other hand to the detectors 40 and 41 to supply differential control signals, and means for amplifying the said control signals connected to the comparison means and adapted to be connected to the feed circuit 23. These amplified control signals may then be transmitted through said connections 44 and 45 to the two control solenoid valves of the jacks 22 integrated in the hydraulic feed circuit of these two jacks via the two switch members 32 and 33.

Finally, with each group of potentiometers 34–36 and 35–37 there is associated a group of two control buttons 46, 48 and 47, 49 respectively, connected to the corresponding switch members 32 and 33.

By depressing these buttons, the tamper operator can thus connect the automatic control circuits 38 and 39 to the solenoid valves of the jacks 22 while disconnecting the manual control members 26 and 27. Upon the ascent again of these buttons, which can be obtained either by a second push or by manual release depending on the type of control button, the selection of which will be dictated by the manner of operation selected, these wires are opened by the switch members 32 and 33 and the control solenoid valves of the jacks 22 are again connected to the manual control members 26 and 27.

In this way, after adjustment of the potentiometers 34 to 37 to amplitude values corresponding to the selected transverse end-of-stroke positions of the tamping units, to the right and to the left of each of the two lines of rails 6 and 7 of the track, the tamper operator can assure the automatic positioning in one direction and/or the other of one and/or the other tamping unit at these selected positions by simply pressing on the corresponding button or buttons.

Figure 5:
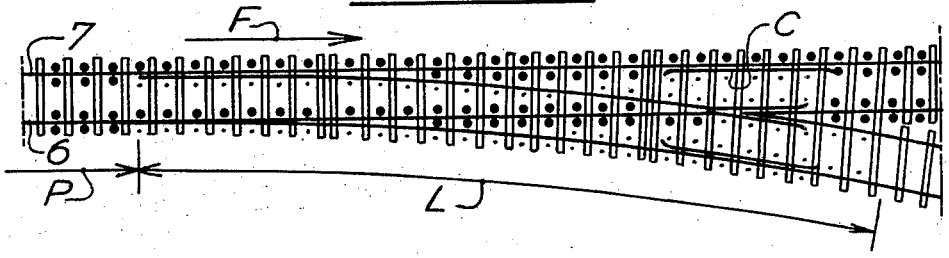
FIG. 5 is an explanatory diagram.

One possibility for the use of this embodiment, given by way of example, is illustrated in FIG. 5, which diagrammatically represents a simple turnout of length L.

In this FIG. 5, in agreement with FIG. 3, the transverse positions of the tamping units corresponding to those used on the open track P, on opposite sides of each line of rails 6 and 7 of the track moved over by the tamping machine are marked by heavy dots and indicated in FIG. 3 by the annotations Ex (position outside the rail) and in (position inside), while all the positions other than these open-track positions are marked by a small dot and designated a and b in FIG. 3.

The tamper operator must assure the putting in place of the tamping units in all these positions in order to assure a proper tamping of such a switch.

It may be recalled here briefly that the tamping takes place by successive plunging and closing of the tamping tools 12 in the ballast around each tie 50 (FIGS. 2 and 3) as close as possible to the rails and the operating elements of the switches, upon each forward step of the machine. The tamper operator is therefore charged with both controlling the amplitude of each forward step of the tamping machine and controlling the transverse position of the tamping units 4 and 5 in order to assure the precision of each plunging of the tool into the ballast.

Before starting the tamping, the tamper operator adjusts the potentiometers 34, 36 and 35, 37 to the amplitude values corresponding to the open track positions Ex and as indicated by the heavy dots in the diagram of FIG. 5. Then, upon the advance in work in the direction indicated by the arrow F, the tamper operator places the two tamping units 4 and 5 in the desired position before each plunge into the ballast on one side and then the other of each row of rails, either by simply pressing on the corresponding button 46, 48, 47 or 49 of the automatic control device upon encountering the open track positions, or by actuating the lever of the corresponding manual control 26 or 27 until obtaining the other positions, by sighting so as to avoid obstacles formed by the parts of the switch such as the points frogs, crossings and check rails shown schematically in said FIG. 5, upon arriving at said elements.

The differentiated representation of the transverse tamping positions clearly shows in this FIG. 5 the large number of positions used in the open track P which are present for each tamping unit over the length L of the turnout, particularly for the tamping unit 5 which is above the line of rails 7 located on the side opposite the competitive track. To the outside of this line of rails 7 it is noted in fact, that the open-track position is repeated without interruption all along the switch.

On the total length L of this switch there are finally counted almost as many recurrent full track positions as other positions, namely about 50% of the total of the necessary positions, with a lack of balance between the two sides of the tamping machine. This proportion, although taken from a diagram, corresponds very closely to the actual facts for this common type of turnout. It makes it possible to note the importance of the gain in time which can thus be obtained as compared with the present total time necessary for the tamping of such a switch by manual control of all the positionings of the tamping units under the same conditions, that is to say with a tamping machine having two tamping units and a single tamping station.

But one can, however, readily acknowledge that on other equipment, such as for instance the so-called "universal" tamping machines with two tamping units per line of rails and two tamper positions, this saving in time, which means an increase in the output of the work of each tamper operator, results in an increase in the overall output of the tamping machine on the track switches.

Within the scope of the invention, the said saving in time may further be increased by presetting the potentiometers to values corresponding to recurrent positions other than those of the open track. Thus, for instance, in FIG. 5 upon the arrival of the tamping machine at the check rail C, the tamping operator may adjust the potentiometer 35 limiting the displacement towards the inside of the track of the tamping unit 5 located above the line of rails 7 to the corresponding positioning which is then repeated along the entire length of this check rail, for which he will then merely have to press the corresponding button 47.

One can also contemplate other recurrent positions such as, for instance, those which are found at the same places on the same track switches and place the corresponding amplitude values in memory, for instance in extensions 380 and 390 of the automatic control circuits 38 and 39, which will then be connected to two extensions 280 and 290 respectively of the control consoles 28 and 29 which will be equipped with corresponding control buttons.

Still within the scope of the invention, one may further contemplate, for instance, on tamping machines equipped with automatic control of the course of the tamping cycles (plunging, closing and opening of the tools, ascent, step-by-step advance), integrating in this control the automatic transverse displacement controlled by the amplitude limiters. This variant is particularly advantageous on tamping machines of the type described having a single tamping unit per line of rails in order to free the tamper operator on the open track from the necessity of pushing the buttons 46 to 49 of the control consoles upon each transfer of the tamping units from one side to the other of the rails before the plunge. In this case, it is sufficient, as a matter of fact, to introduce a release sequence for the transverse movement of the tamping units acting directly on the switch members 32 and 33 after the ascent and before the following pluning of the said units.

Other variations can be employed.

Thus, the amplitude limiter may be formed of a mechanical or electric end-of-stroke switch, for instance in the simple case of limiting the adjustment of the amplitude of the displacement of the tamping unit solely to the open-track recurrent positions. In this case, the switch member will be formed of a remote controlled retraction mechanism for the meahanical end-of-stroke or by a disconnect switch for an electric end-of-stroke. In this case also, the use of a displacement detector will be superfluous, the end-of-stroke constituting both amplitude limiter and detector of the arrival of the tamping unit at the position selected.

What is claimed is:

1. A railway track tamping machine comprising in combination:

(a) a rolling chassis;

(b) at least one tamping unit mounted on said rolling chassis so as to be displaceable in the transverse direction of the track to avoid upon tamping of track switches lateral obstacles such as turnouts and crossovers upon arrival at such switches;

(c) motor means connected to said tamping unit to displace said tamping unit in the transverse direction of the track;

(d) an energy feed circuit connected to said motor means;

(e) a first and a second connection with said energy feed circuit;

(f) manual control means connected to said first connection to cause said displacement of the tamping unit and stop it at a selected amplitude avoiding the said lateral obstacles;

(g) manually controlled amplitude limiting means for setting the amplitude of said displacement at least at one selected value;

(h) automatic control circuit means connected to and controlled by said manually controlled amplitude limiting means, said automatic control circuit means being further connected to said second connection for displacing the tamping unit at said selected amplitude value; and (i) manually controlled switch means arranged between said first and second connections and said energy feed circuit to connect to said energy feed circuit either said manual control means or said automatic control circuit means, whereby the transverse positions of the tamping unit which are recurrent along some places of the track switch may be selected, obtained and memorized via the manually controlled amplitude limiting means and used for tamping along these places by mere passage from the manual control means to the automatic control circuit means via the manually trolled switch means.

* * * * *